US011859638B2

(12) United States Patent
Huang

(10) Patent No.: US 11,859,638 B2
(45) Date of Patent: Jan. 2, 2024

(54) WATER PUMP WITH ADJUSTABLE WATER DISCHARGE DIRECTION

(71) Applicant: Bingbiao Huang, Guigang (CN)

(72) Inventor: Bingbiao Huang, Guigang (CN)

( * ) Notice: Subject to any disclaimer, the term of this patent is extended or adjusted under 35 U.S.C. 154(b) by 0 days.

(21) Appl. No.: 18/451,070

(22) Filed: Aug. 16, 2023

(65) Prior Publication Data

US 2023/0392609 A1 Dec. 7, 2023

(51) Int. Cl.

| | |
|---|---|
| ***F04D 29/42*** | (2006.01) |
| ***F04D 29/70*** | (2006.01) |
| ***F04D 17/08*** | (2006.01) |
| ***F04D 13/06*** | (2006.01) |
| ***F04D 29/08*** | (2006.01) |
| ***F04D 13/08*** | (2006.01) |
| ***F04D 29/62*** | (2006.01) |
| ***F04D 29/02*** | (2006.01) |
| ***F04D 15/02*** | (2006.01) |
| ***F04D 29/60*** | (2006.01) |
| ***F04D 29/043*** | (2006.01) |

(52) U.S. Cl.

CPC ..... *F04D 29/4293* (2013.01); *F04D 13/06* (2013.01); *F04D 13/0606* (2013.01); *F04D 13/0626* (2013.01); *F04D 13/08* (2013.01); *F04D 13/086* (2013.01); *F04D 15/0218* (2013.01); *F04D 17/08* (2013.01); *F04D 29/026* (2013.01); *F04D 29/043* (2013.01); *F04D 29/086* (2013.01); *F04D 29/426* (2013.01); *F04D 29/605* (2013.01); *F04D 29/628* (2013.01); *F04D 29/708* (2013.01)

(58) Field of Classification Search

CPC ..... F04D 13/06; F04D 13/086; F04D 29/426; F04D 29/628; F04D 15/0218; F04D 13/0606; F04D 29/4293; F04D 13/08; F04D 29/026; F04D 29/086; F04D 29/605; F04D 13/0626; F04D 29/043; F04D 17/08; F04D 29/708

See application file for complete search history.

(56) References Cited

U.S. PATENT DOCUMENTS 6,821,416 B1 * 11/2004 Kelly ..... A01K 63/00 415/110
9,810,241 B2 * 11/2017 Gell, III ..... F04D 29/406

FOREIGN PATENT DOCUMENTS

CN 104265646 A 1/2015
CN 115773257 A 3/2023

* cited by examiner

*Primary Examiner* — Peter J Bertheaud

(57) ABSTRACT

Disclosed is a water pump with an adjustable water discharge direction, which comprises a pump shell, a rotating shaft, a rotor, a stator and an impeller; a mounting cavity and a pump cavity which are isolated from each other are arranged in the pump shell, and the pump shell is provided with a water inlet and a water outlet; the rotating shaft is rotatably arranged in the pump shell, a front end of the rotating shaft is located in the pump cavity, and a rear end of the rotating shaft is located in the mounting cavity; the rotor is arranged at the rear end of the rotating shaft and located in the mounting cavity; the stator is arranged in the mounting cavity and encloses an outer periphery of the rotor; the impeller is arranged at the front end of the rotating shaft and located in the pump cavity.

18 Claims, 6 Drawing Sheets

WATER PUMP WITH ADJUSTABLE WATER DISCHARGE DIRECTION

TECHNICAL FIELD

The present invention relates to the technical field of water pumps, and particularly refers to a water pump with an adjustable water discharge direction.

BACKGROUND OF THE PRESENT INVENTION

A water pump is a machine for transporting or pressurizing a liquid, which transfers mechanical energy or other external energy of a prime mover to the liquid, so as to increase energy of the liquid, and is mainly used for transporting liquids, such water, oil, acid-base liquid, emulsion, suspension emulsion and liquid metal, or may also transport a liquid, a gas mixture and a liquid containing a suspended solid.

At present, a main structure of the water pump comprises a pump shell, a rotating shaft, a rotor, a stator and an impeller; a mounting cavity and a pump cavity which are isolated from each other are arranged in the pump shell, the pump shell is provided with a water inlet and a water outlet, and the water inlet and the water outlet are both communicated with the pump cavity; the rotating shaft is rotatably arranged in the pump shell, a front end of the rotating shaft is located in the pump cavity, and a rear end of the rotating shaft is located in the mounting cavity; the rotor is arranged at the rear end of the rotating shaft and located in the mounting cavity; the stator is arranged in the mounting cavity and encloses an outer periphery of the rotor; and the impeller is arranged at the front end of the rotating shaft and located in the pump cavity, an input side of the impeller is opposite to the water inlet, and an output side of the impeller is opposite to the water outlet.

However, in the prior art, a direction of the water outlet of the water pump is generally fixed and unadjustable, so that a water discharge direction cannot be adjusted according to the needs of use, thus bringing inconvenience to use. Therefore, it is necessary to improve the existing water pump.

SUMMARY OF PRESENT INVENTION

In view of this, the present invention aims at the defects in the prior art, and is mainly intended to provide a water pump with an adjustable water discharge direction, which can effectively solve the problem of unadjustable water discharge direction of an existing water pump.

In order to achieve the above object, the following technical solutions are used in the present invention.

A water pump with an adjustable water discharge direction comprises a pump shell, a rotating shaft, a rotor, a stator and an impeller; a mounting cavity and a pump cavity which are isolated from each other are arranged in the pump shell, the pump shell is provided with a water inlet and a water outlet, and the water inlet and the water outlet are both communicated with the pump cavity; the rotating shaft is rotatably arranged in the pump shell, a front end of the rotating shaft is located in the pump cavity, and a rear end of the rotating shaft is located in the mounting cavity; the rotor is arranged at the rear end of the rotating shaft and located in the mounting cavity; the stator is arranged in the mounting cavity and encloses an outer periphery of the rotor; the impeller is arranged at the front end of the rotating shaft and located in the pump cavity, an input side of the impeller is opposite to the water inlet, and an output side of the impeller is opposite to the water outlet; and the pump shell comprises a pump body and a pump cover, the above mounting cavity is located in the pump body, the pump cover is rotatably mounted at a front end of the pump body at an adjustable angle and forms the above pump cavity in an enclosing way, and the above water inlet and the above water outlet are both located on the pump cover.

Preferably, the pump body is provided with a handle seat, and a top portion of the handle seat is provided with a handle.

Preferably, the handle seat is detachably sleeved on the pump body.

Preferably, a bottom portion of the handle seat is provided with a sucker.

Preferably, various corners of the bottom portion of the handle seat are all provided with a clamping groove, and one sucker is clamped and fixed in each clamping groove.

Preferably, the bottom portion of the handle seat is provided with a cavity, and a plurality of suckers are located on an outer periphery of the cavity.

Preferably, the handle seat has an integrated 3D molded structure.

Preferably, a front side of the pump cover is provided with a filter cover, and the filter cover covers the water inlet.

Preferably, the filter cover is detachably mounted on the front side of the pump cover.

Preferably, the water inlet is provided with a first external thread.

Preferably, the filter cover is cylindrical, and has an integrated 3D molded structure.

Preferably, a convex ring radially extends from an outer side surface of a front end of the pump body, a plurality of hook portions extend from a rear end of the pump cover, and the plurality of hook portions hook the convex ring and rotate back and forth along the convex ring.

Preferably, a sealing ring is clamped between the rear end of the pump cover and the front end of the pump body.

Preferably, the outer side surface of the front end of the pump body is concavely provided with an annular groove, the annular groove is located on a front side of the convex ring, and the sealing ring is embedded in the annular groove for fixing.

Preferably, the water outlet is provided with a second external thread.

Preferably, the water outlet is detachably provided with a water discharge connector, the water discharge connector is provided with a threaded sleeve, and the threaded sleeve is threadedly connected with the second external thread for fixing.

Preferably, the water inlet is coaxially arranged with a rotation center of the pump cover.

Preferably, the water outlet is perpendicular to a rotation center of the pump cover.

Preferably, the pump body has a horizontal cylindrical structure.

Preferably, the pump body comprises a main barrel and a rear cover, and the rear cover is hermetically mounted at a rear end of the main barrel to form the mounting cavity in an enclosing way.

Compared with the prior art, the present invention has obvious advantages and beneficial effects, and specifically, according to the above technical solutions.

I. The water inlet and the water outlet are both arranged on the pump cover, and the pump cover is rotatably mounted at the front end of the pump body at the adjustable angle, so that the water discharge direction can be adjusted at any angle according to the needs of use, and the water pump can work normally, thus bringing convenience to use.

II. The handle seat is provided, the bottom portion of the handle seat is provided with the sucker, and the handle seat may be used for transportation in advance, thus being very convenient, and the sucker may be used for equilibrium adsorption on a plane, thus improving a pumping stability of the water pump.

DESCRIPTION OF REFERENCE NUMERALS

Figure 1:
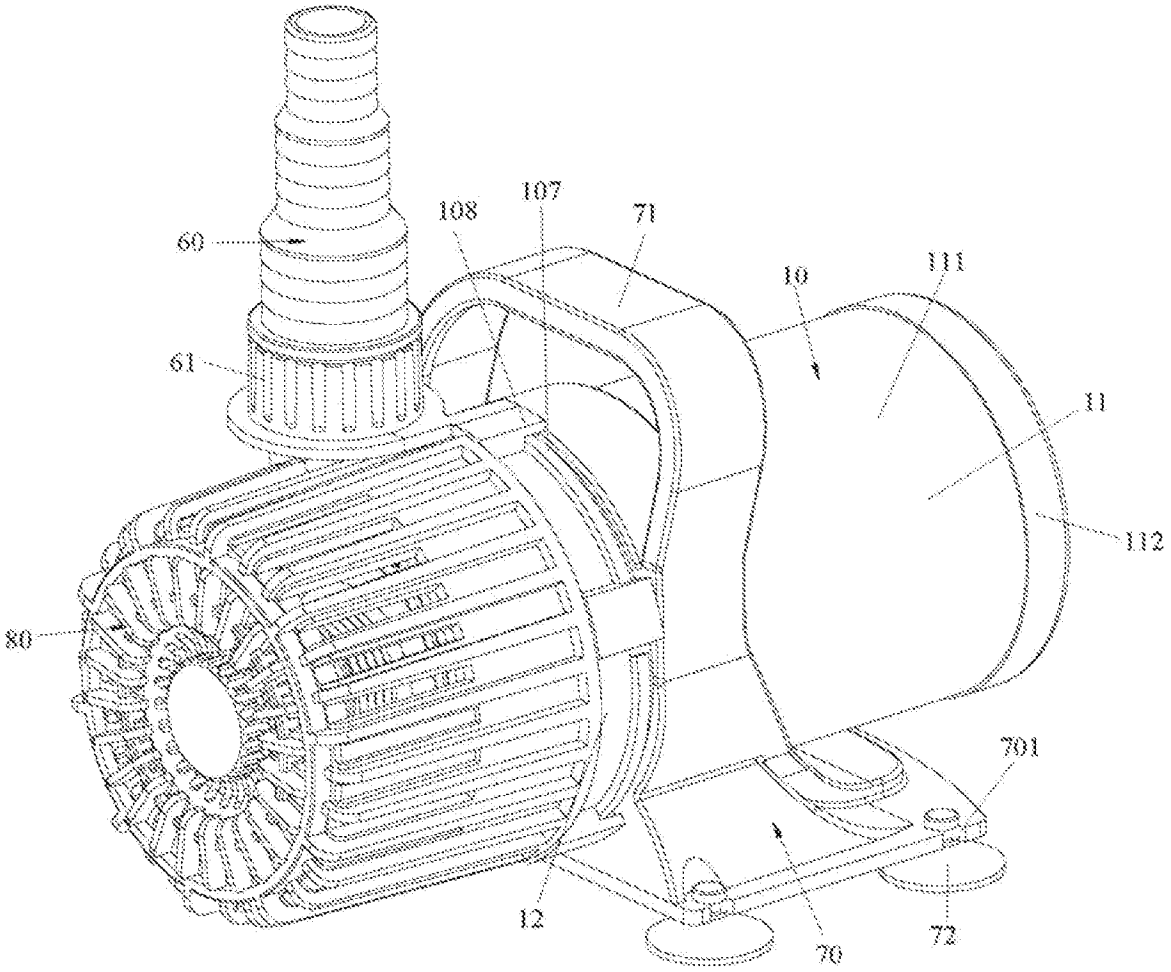
FIG. 1 is a stereoscopic diagram of assembly of a preferred embodiment of the present invention.

10 refers to pump shell
11 refers to pump body
111 refers to main barrel
112 refers to real cover
113 refers to line passing pipe
12 refers to pump cover
13 refers to sealing ring
101 refers to mounting cavity
102 refers to pump cavity
103 refers to water inlet
104 refers to water outlet
105 refers to first external thread
106 refers to second external thread
107 refers to convex ring
108 refers to hook portion
109 refers to annular groove
20 refers to rotating shaft
30 refers to rotor
40 refers to stator
50 refers to impeller
51 refers to clamping spring
60 refers to water discharge connector
61 refers to threaded sleeve
70 refers to handle seat
71 refers to handle
72 refers to sucker
701 refers to clamping groove
702 refers to cavity
80 refers to filter cover

DETAILED DESCRIPTION OF PREFERRED EMBODIMENTS

Figure 2:
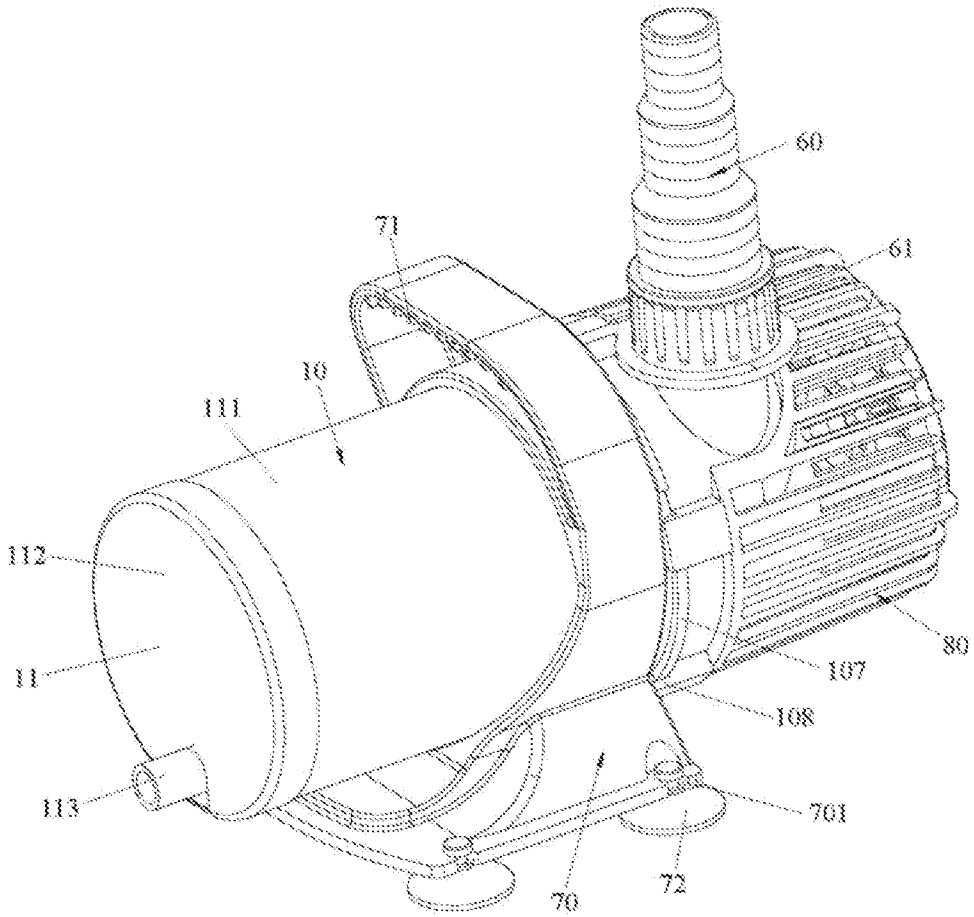
FIG. 2 is a stereoscopic diagram of assembly of the preferred embodiment of the present invention from another perspective.
Figure 3:
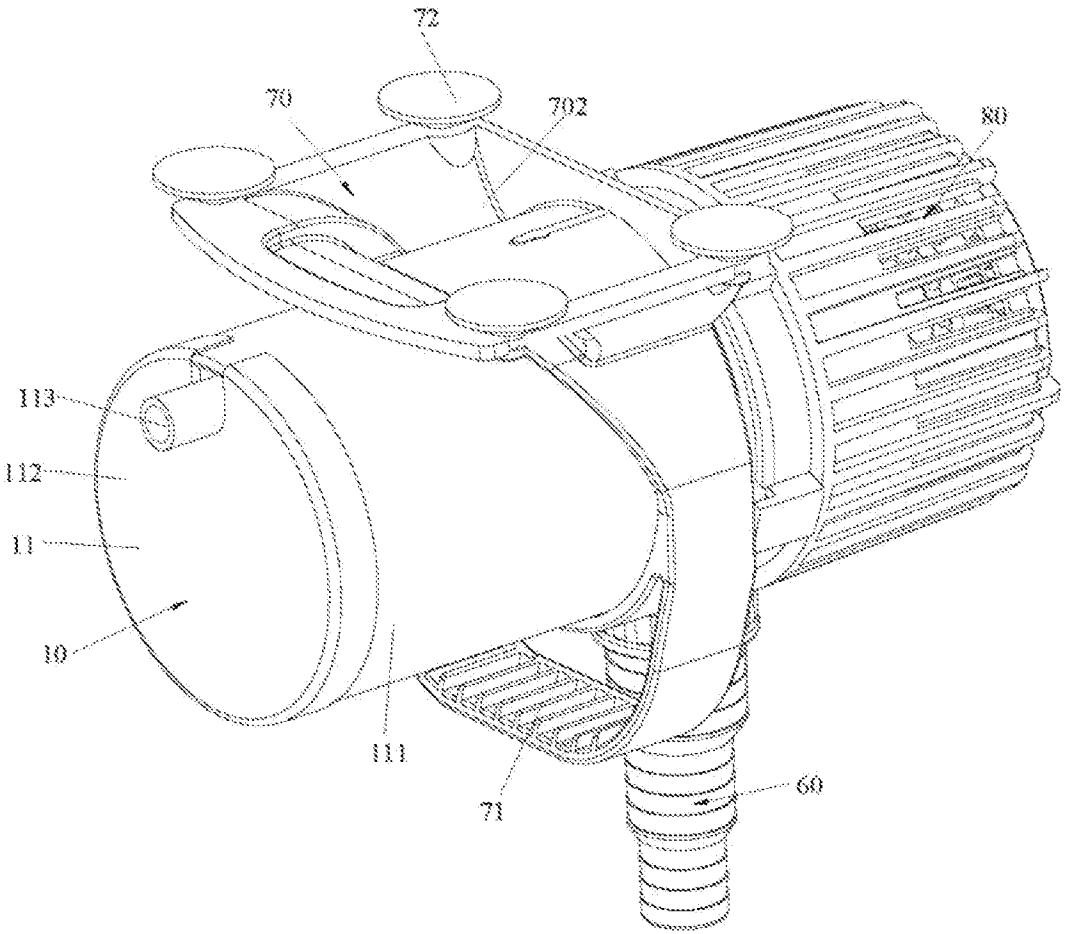
FIG. 3 is a stereoscopic diagram of assembly of the preferred embodiment of the present invention from yet another perspective.
Figure 4:
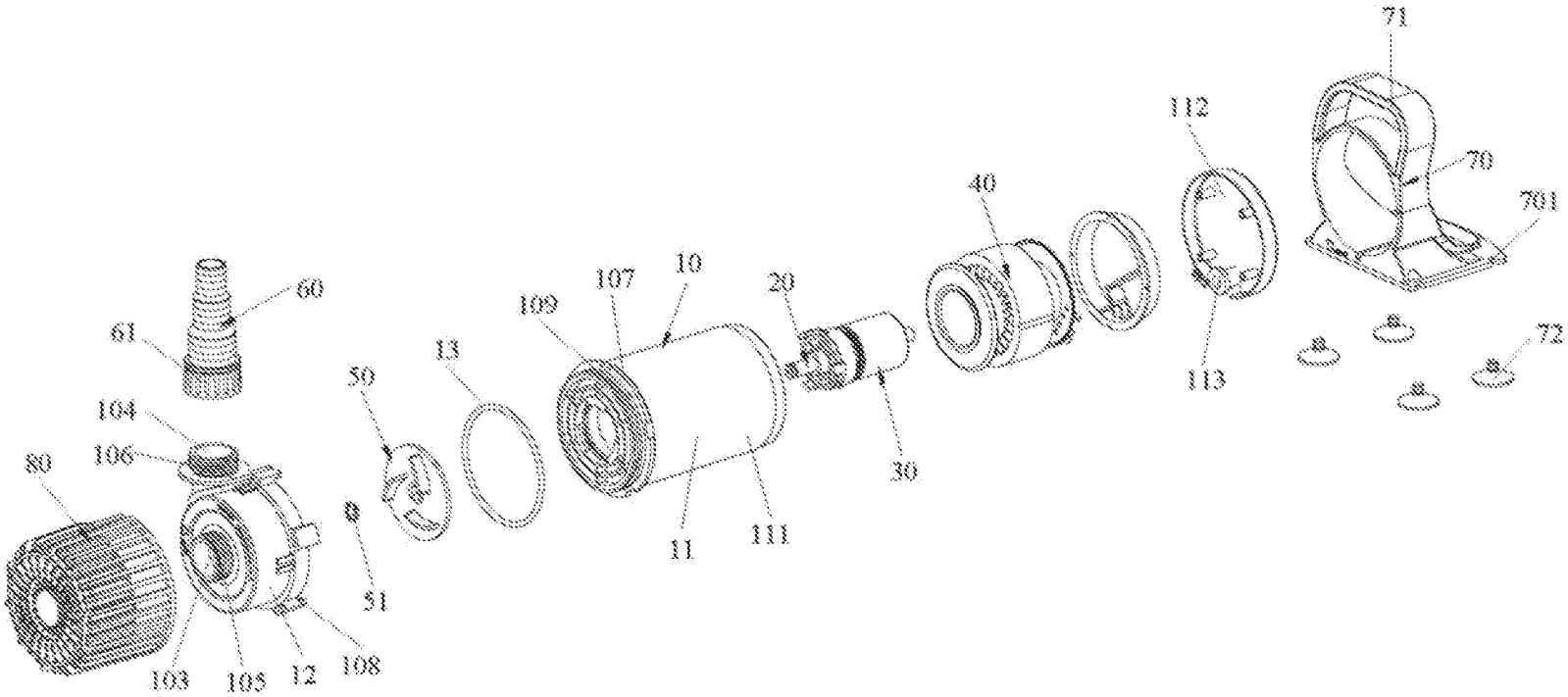
FIG. 4 is an exploded view of the preferred embodiment of the present invention.
Figure 5:
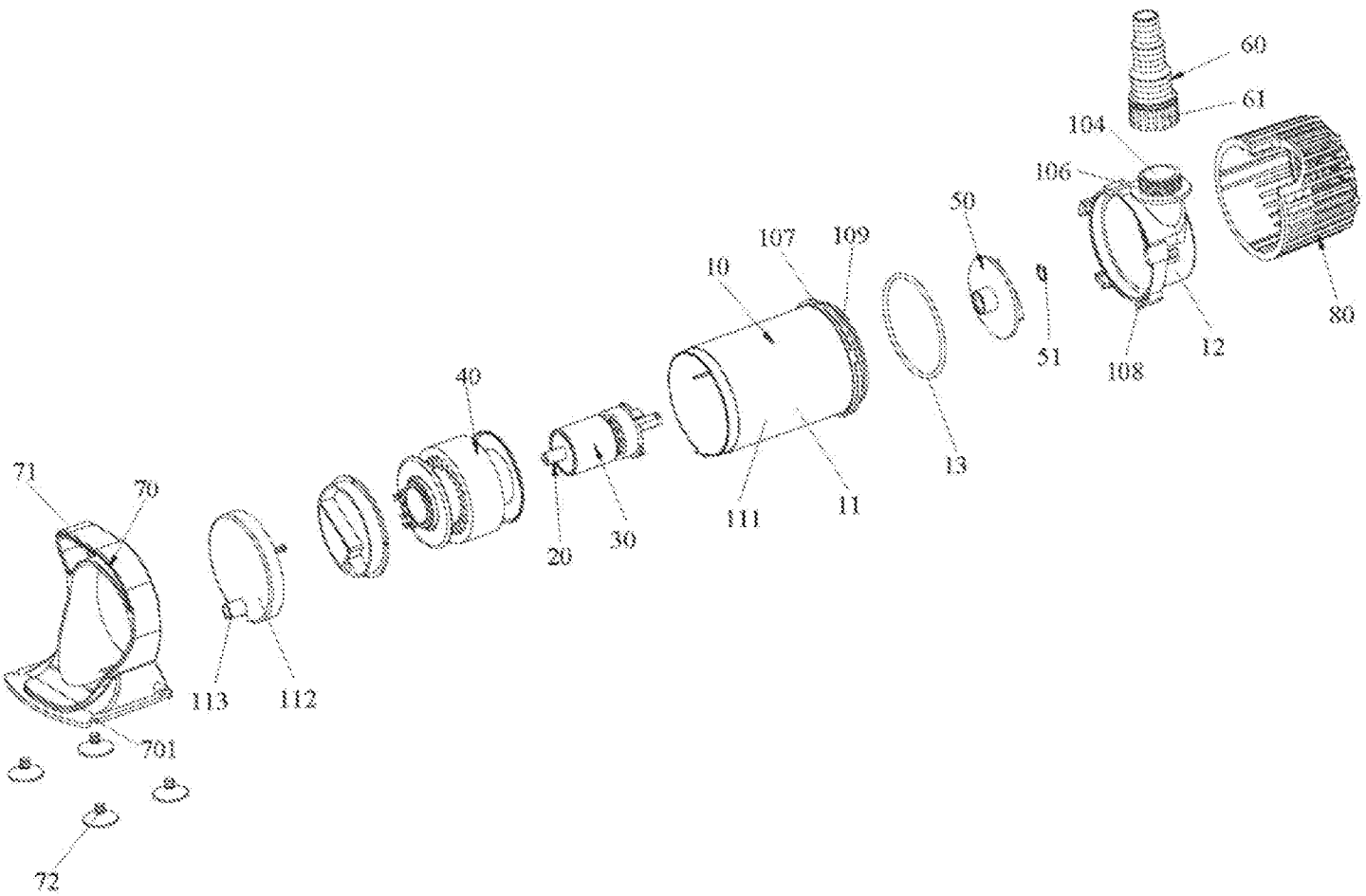
FIG. 5 is an exploded view of the preferred embodiment of the present invention from another perspective.
Figure 6:
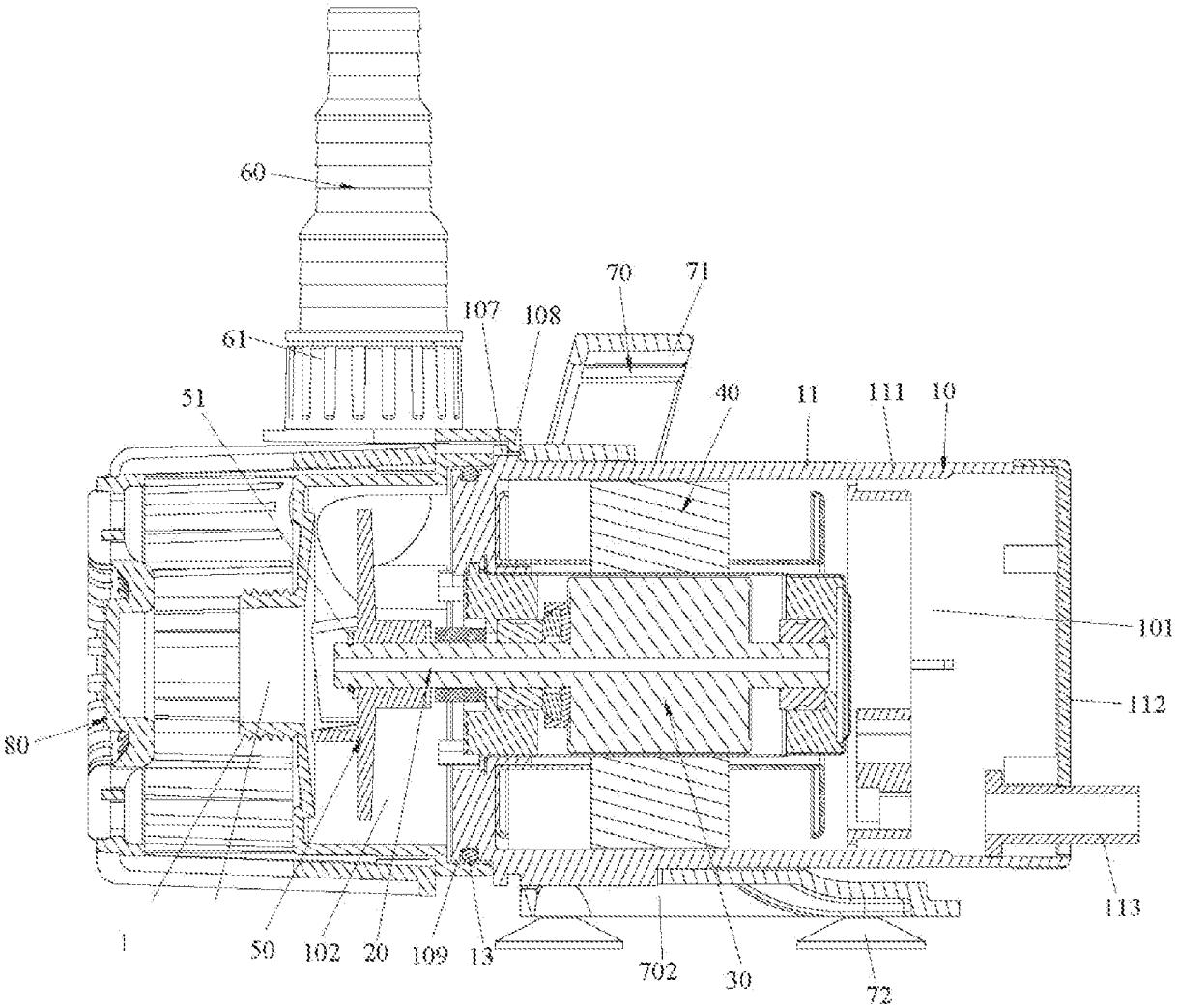
FIG. 6 is a sectional view of the preferred embodiment of the present invention.

With reference to FIG. 1 to FIG. 6, a specific structure of a preferred embodiment of the present invention is shown, which comprises a pump shell 10, a rotating shaft 20, a rotor 30, a stator 40 and an impeller 50.

A mounting cavity 101 and a pump cavity 102 which are isolated from each other are arranged in the pump shell 10, the pump shell 10 is provided with a water inlet 103 and a water outlet 104, and the water inlet 103 and the water outlet 104 are both communicated with the pump cavity 102. Specifically, the pump shell 10 comprises a pump body 11 and a pump cover 12, the above mounting cavity 101 is located in the pump body 11, the pump cover 12 is rotatably mounted at a front end of the pump body 11 at an adjustable angle and forms the above pump cavity 102 in an enclosing way, and the above water inlet 103 and the above water outlet 104 are both located on the pump cover 12.

In the embodiment, the pump body 11 has a horizontal cylindrical structure. Specifically, the pump body 11 comprises a main barrel 111 and a rear cover 112, and the rear cover 112 is hermetically mounted at a rear end of the main barrel 111 to form the mounting cavity 101 in an enclosing way. The rear cover 112 is provided with a line passing pipe 113, and the line passing pipe 113 communicates the mounting cavity 101 with the outside, has a simple structure, and is convenient to assemble.

The water inlet 103 is provided with a first external thread 105, so as to be connected with a pumping pipe as needed. The water outlet 104 is provided with a second external thread 106. The water outlet 104 is detachably provided with a water discharge connector 60, the water discharge connector 60 is provided with a threaded sleeve 61, and the threaded sleeve 61 is threadedly connected with the second external thread 106 for fixing, so as to be quickly connected with a water discharge pipe. Meanwhile, a multi-caliber universal water discharge connector 60 may be provided, thus having diversity and aesthetics. Moreover, the water inlet 103 is coaxially arranged with a rotation center of the pump cover 12, so that water inflow is smooth. The water outlet 104 is perpendicular to the rotation center of the pump cover 12, so that water discharge is smooth.

A convex ring 107 radially extends from an outer side surface of a front end of the pump body 11, a plurality of hook portions 108 extend from a rear end of the pump cover 12, and the plurality of hook portions 108 hook the convex ring 107 and rotate back and forth along the convex ring 107, so that the pump cover 12 rotates steadily. A sealing ring 13 is clamped between the rear end of the pump cover 12 and the front end of the pump body 11, so as to realize hermetic mounting. Moreover, the outer side surface of the front end of the pump body 11 is concavely provided with an annular groove 109, the annular groove 109 is located on a front side of the convex ring 107, and the sealing ring 13 is embedded in the annular groove 109 for fixing, so that the sealing ring 13 is mounted firmly.

The pump body 11 is provided with a handle seat 70, and a top portion of the handle seat 70 is provided with a handle 71, so as to carry by the handle. The handle seat 70 is detachably sleeved on the pump body 11, which is convenient for disassembly and assembly. Moreover, a bottom portion of the handle seat 70 is provided with a sucker 72, so as to be adsorbed and fixed with the outside. Moreover, various corners of the bottom portion of the handle seat 70 are all provided with a clamping groove 701, and one sucker 72 is clamped and fixed in each clamping groove 701, so that the adsorption with the outside is firmer. The bottom portion of the handle seat 70 is provided with a cavity 702, and a plurality of suckers 72 are located on an outer periphery of the cavity 702, thus further improving the firmness of the adsorption with the outside. The handle seat 70 has an integrated 3D molded structure, which is simple in structure and good in intensity.

A front side of the pump cover 12 is provided with a filter cover 80, and the filter cover 80 covers the water inlet 103.

The filter cover 80 is detachably mounted on the front side of the pump cover 12, which may be disassembled and assembled as needed, thus being flexible and convenient to use. Moreover, the filter cover 80 is cylindrical, and has an integrated 3D molded structure, which is simple in structure and good in intensity.

The rotating shaft 20 is rotatably arranged in the pump shell 10, a front end of the rotating shaft 20 is located in the pump cavity 102, and a rear end of the rotating shaft 20 is located in the mounting cavity 101.

The rotor 30 is arranged at the rear end of the rotating shaft 20 and located in the mounting cavity 101. The stator 40 is arranged in the mounting cavity 101 and encloses an outer periphery of the rotor 30. The stator 40 is cooperated with the rotor to make the rotor 30 rotate.

The impeller 50 is arranged at the front end of the rotating shaft 20 and located in the pump cavity 102, an input side of the impeller 50 is opposite to the water inlet 103, and an output side of the impeller 50 is opposite to the water outlet 104. In the embodiment, the impeller 50 is fixedly mounted at the front end of the rotating shaft 20 through a clamping spring 51.

A working principle of the embodiment is described in detail as follows.

During working, the product may be integrally immersed in water, and a water pipe is connected with the water discharge connector 60. When a power supply is turned on, the stator 40 is cooperated with the rotor 30 to make the rotor 30 rotate, so that the rotating shaft 20 drives the impeller 50 to rotate at a high speed. After being filtered by the filter cover 80, water enters the pump cavity 102 from the water inlet 103, under drive of the impeller 50, the water is pressurized to be output from the water outlet 104, and then the water is output from the water pipe to a designated place. By manually rotating the pump cover 12 left and right, a water discharge direction may be changed.

Keys of design of the present invention are that: firstly, the water inlet and the water outlet are both arranged on the pump cover, and the pump cover is rotatably mounted at the front end of the pump body at the adjustable angle, so that the water discharge direction can be adjusted at any angle according to the needs of use, and the water pump can work normally, thus bringing convenience to use. Secondly, the handle seat is provided, the bottom portion of the handle seat is provided with the sucker, and the handle seat may be used for transportation in advance, thus being very convenient, and the sucker may be used for equilibrium adsorption on a plane, thus improving a pumping stability of the water pump.

Technical principles of the present invention are described above with reference to specific embodiments. These descriptions are only for the purpose of explaining the principles of the present invention, and cannot be interpreted as limiting the scope of protection of the present invention in any way. Based on the explanation herein, those skilled in the art may think of other specific embodiments of the present invention without going through any creative work, which will all fall within the scope of protection of the present invention.

I claim:

1. A water pump with an adjustable water discharge direction, comprising a pump shell, a rotating shaft, a rotor, a stator and an impeller; a mounting cavity and a pump cavity which are isolated from each other being arranged in the pump shell, the pump shell being provided with a water inlet and a water outlet, and the water inlet and the water outlet being both communicated with the pump cavity; the rotating shaft being rotatably arranged in the pump shell, a front end of the rotating shaft being located in the pump cavity, and a rear end of the rotating shaft being located in the mounting cavity; the rotor being arranged at the rear end of the rotating shaft and located in the mounting cavity; the stator being arranged in the mounting cavity and enclosing an outer periphery of the rotor; and the impeller being arranged at the front end of the rotating shaft and located in the pump cavity, an input side of the impeller being opposite to the water inlet, and an output side of the impeller being opposite to the water outlet, wherein the pump shell comprises a pump body and a pump cover, said mounting cavity is located in the pump body, the pump cover is rotatably mounted at a front end of the pump body at an adjustable angle and forms said pump cavity in an enclosing way, and said water inlet and said water outlet are both located on the pump cover wherein the pump body is provided with a handle seat, and a top portion of the handle seat is provided with a handle, the handle seat is detachably sleeved on the pump body.

2. The water pump with the adjustable water discharge direction according to claim 1, wherein a bottom portion of the handle seat is provided with a sucker.

3. The water pump with the adjustable water discharge direction according to claim 2, wherein various corners of the bottom portion of the handle seat are all provided with a clamping groove, and one sucker is clamped and fixed in each clamping groove.

4. The water pump with the adjustable water discharge direction according to claim 3, wherein the bottom portion of the handle seat is provided with a cavity, and a plurality of suckers are located on an outer periphery of the cavity.

5. The water pump with the adjustable water discharge direction according to claim 3, wherein the handle seat has an integrated 3D molded structure.

6. The water pump with the adjustable water discharge direction according to claim 1, wherein a front side of the pump cover is provided with a filter cover, and the filter cover covers the water inlet.

7. The water pump with the adjustable water discharge direction according to claim 6, wherein the filter cover is detachably mounted on the front side of the pump cover.

8. The water pump with the adjustable water discharge direction according to claim 6, wherein the water inlet is provided with a first external thread.

9. The water pump with the adjustable water discharge direction according to claim 6, wherein the filter cover is cylindrical, and has an integrated 3D molded structure.

10. The water pump with the adjustable water discharge direction according to claim 1, wherein a convex ring radially extends from an outer side surface of a front end of the pump body, a plurality of hook portions extend from a rear end of the pump cover, and the plurality of hook portions hook the convex ring and rotate back and forth along the convex ring.

11. The water pump with the adjustable water discharge direction according to claim 10, wherein a sealing ring is clamped between the rear end of the pump cover and the front end of the pump body.

12. The water pump with the adjustable water discharge direction according to claim 11, wherein the outer side surface of the front end of the pump body is concavely provided with an annular groove, the annular groove is located on a front side of the convex ring, and the sealing ring is embedded in the annular groove for fixing.

13. The water pump with the adjustable water discharge direction according to claim 1, wherein the water outlet is provided with a second external thread.

14. The water pump with the adjustable water discharge direction according to claim 13, wherein the water outlet is detachably provided with a water discharge connector, the water discharge connector is provided with a threaded sleeve, and the threaded sleeve is threadedly connected with the second external thread for fixing.

15. The water pump with the adjustable water discharge direction according to claim 1, wherein the water inlet is coaxially arranged with a rotation center of the pump cover.

16. The water pump with the adjustable water discharge direction according to claim 1, wherein the water outlet is perpendicular to a rotation center of the pump cover.

17. The water pump with the adjustable water discharge direction according to claim 1, wherein the pump body has a horizontal cylindrical structure.

18. The water pump with the adjustable water discharge direction according to claim 17, wherein the pump body comprises a main barrel and a rear cover, and the rear cover is hermetically mounted at a rear end of the main barrel to form the mounting cavity in an enclosing way.

* * * * *